US009452852B2

(12) United States Patent
Sambuca, Jr.

(10) Patent No.: US 9,452,852 B2
(45) Date of Patent: Sep. 27, 2016

(54) SENSOR ASSEMBLY AND/OR A CASE SEALER UTILIZING A SENSOR ASSEMBLY

(75) Inventor: Anthony J. Sambuca, Jr., Honesdale, PA (US)

(73) Assignee: Signode Industrial Group LLC, Glenview, IL (US)

( * ) Notice: Subject to any disclaimer, the term of this patent is extended or adjusted under 35 U.S.C. 154(b) by 711 days.

(21) Appl. No.: 13/280,988

(22) Filed: Oct. 25, 2011

(65) Prior Publication Data

US 2012/0102893 A1 May 3, 2012

Related U.S. Application Data

(60) Provisional application No. 61/409,268, filed on Nov. 2, 2010.

(51) Int. Cl.

| | |
|---|---|
| ***B65B 51/06*** | (2006.01) |
| ***B65B 59/00*** | (2006.01) |
| *B65B 67/02* | (2006.01) |

(52) U.S. Cl.

CPC ..... *B65B 51/067* (2013.01); *B65B 59/005* (2013.01); *B65B 67/02* (2013.01)

(58) Field of Classification Search

CPC ... B29C 66/849; B65B 7/164; B65B 51/067; B65B 51/02; B65B 51/005; B31B 1/00

USPC ..... 53/75, 76, 136.1, 136.4, 476, 285, 52

See application file for complete search history.

(56) References Cited

U.S. PATENT DOCUMENTS

| | | | | |
|---|---|---|---|---|
| 2,841,305 | A * | 7/1958 | Werner | 156/355 |
| 4,061,526 | A * | 12/1977 | Warshaw et al. | 53/136.4 |
| 4,238,269 | A * | 12/1980 | Deering, Jr. | 156/465 |
| 4,541,888 | A * | 9/1985 | Marchetti | 156/468 |
| 4,781,786 | A * | 11/1988 | Lerner | B65B 51/067 156/468 |
| 5,025,608 | A * | 6/1991 | Marchetti | 53/135.1 |
| 5,228,943 | A * | 7/1993 | Vasilakes | 156/468 |
| 5,626,708 | A * | 5/1997 | Vasilakes et al. | 156/468 |
| 6,318,048 | B1 * | 11/2001 | Sambuca, Jr. | 53/136.4 |
| 7,383,864 | B2 * | 6/2008 | Hogerton et al. | 156/350 |
| 2003/0189490 | A1 | 10/2003 | Hogerton | |

FOREIGN PATENT DOCUMENTS

| | | |
|---|---|---|
| EP | 0502276 A2 | 9/1992 |
| GB | 2116515 A | 9/1983 |

OTHER PUBLICATIONS

Extended European Search Report issued in connection with EP App. No. 11187400.4 on Mar. 29, 2012.

* cited by examiner

*Primary Examiner* — Andrew M Tecco

(74) *Attorney, Agent, or Firm* — Levenfeld Pearlstein, LLC

(57) ABSTRACT

A case sealer includes a frame assembly, a top head assembly coupled to move substantially vertically with respect to the frame assembly, and a sensor associated with the top head assembly for sensing a front face and the presence of a case to be sealed. The case sealer also includes a controller for moving the top head assembly substantially vertically when the sensor senses the front face of the case and for preventing the substantially vertical movement of the top head assembly when the sensor senses the presence of the case.

8 Claims, 8 Drawing Sheets

SENSOR ASSEMBLY AND/OR A CASE SEALER UTILIZING A SENSOR ASSEMBLY

CROSS-REFERENCE TO RELATED APPLICATION DATA

This application claims the benefit of priority of Provisional U.S. Patent Application Ser. No. 61/409,268, filed Nov. 2, 2010, the disclosure of which is incorporated herein by reference.

BACKGROUND

Case sealers are generally utilized to apply a sealing tape to a surface of a case or box to be sealed. Such case sealers can be automatic or semi-automatic, at least partially human operated, in design. Further, case sealers can be adapted to apply a sealing tape to multiple surfaces of a case, for example, to top and bottom surfaces or faces of a box where flaps are folded over and form seams.

Various issues arise in the design of automatic and semi-automatic case sealers, for example, efficiency, reliability, speed, cost, ease of maintenance, durability, versatility, etc. One such issue is that known sealers can apply too great of a force on the front and/or top faces of a case to be sealed. This can result in crushing the case. This is particularly problematic with cases that are underfilled. The converse is also problematic—cases that are overfilled may not be the readily fully closed and sealed.

Accordingly, there is a need for a case sealer having a sensor that can be utilized with automatic and semi-automatic case sealers to provide improvements relating to properly sealing cases, including those that are underfilled and overfilled.

SUMMARY

According to one example, a case sealer includes a frame assembly, a top head assembly coupled to move substantially vertically with respect to the frame assembly, and a sensor associated with the top head assembly for sensing a front face and a top face of a case to be sealed. The case sealer also includes a controller for moving the top head assembly substantially vertically when the sensor senses the front face of the case and for preventing the substantially vertical movement of the top head assembly when the sensor senses the top face of the case.

According to another example, a sensor assembly for use with a top head assembly of a case sealer includes a first switch that is activated to cause the top head assembly to move upward with respect to the case sealer and a second switch that is activated to prevent the top head assembly from moving upward due to activation of the first switch until the second switch is deactivated.

Another example is directed to a method for sealing a case in a case sealer that includes the steps of sensing a front face of the case, moving a top head assembly of the case sealer upward in response to sensing the front face, and stopping the upward movement of the top head assembly when the front face of the case is no longer sensed. The method also includes the steps of sensing a top face of the case as the case is moved forward and the top head assembly moved downward, wherein sensing the top face of the case prevents the top head assembly from moving upward until the top face is no longer sensed, and sealing the case as it is moved forward through the case sealer.

BRIEF DESCRIPTION OF THE DRAWINGS

Details of the present disclosure, including non-limiting benefits and advantages, will become more readily apparent to those of ordinary skill in the relevant art after reviewing the following detailed description and accompanying drawings, wherein.

DETAILED DESCRIPTION

Figure 1:
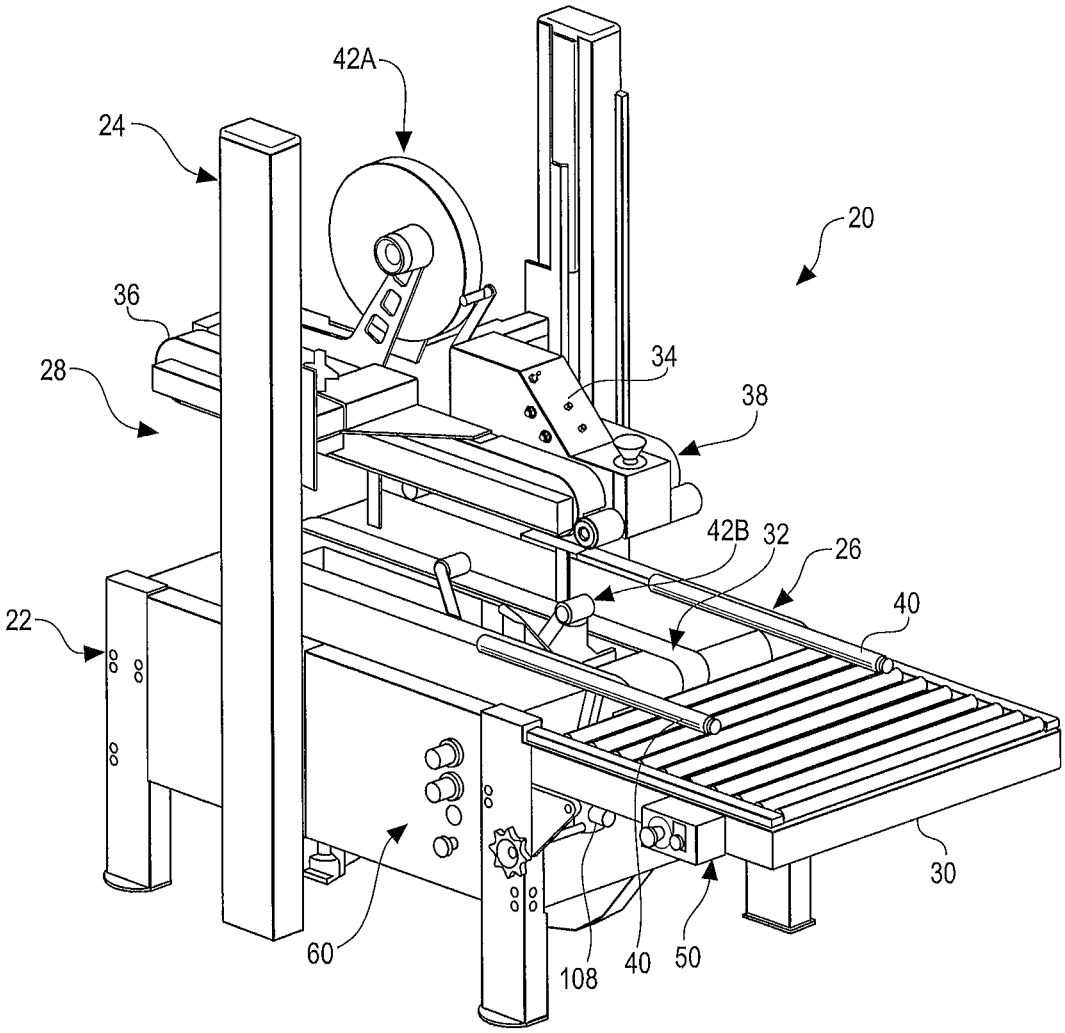
FIG. 1 is an isometric view of a case sealer according to one example.

While the present disclosure is susceptible of embodiment in various forms, there is shown in the drawings and will hereinafter be described one or more embodiments with the understanding that the present disclosure is to be considered illustrative only and is not intended to limit the disclosure to any specific embodiment described or illustrated.

Referring to FIG. 1, a case sealer 20 according to one embodiment includes a frame assembly 22 and a mast assembly 24 disposed about the frame assembly 22. The frame assembly 22 includes an infeed end 26 and an outfeed end 28. A pack table 30 abuts and may be coupled to the infeed end 26 of the frame assembly 22 in any known manner. Further, a bottom drive 32 (best seen in FIG. 4) is coupled to the frame assembly 22 and a top head assembly 34 is coupled to the mast assembly 24 and configured to move vertically therealong. The top head assembly 34 includes a top drive 36 and a sensing paddle 38, as will be described in more detail hereinafter. Movable side rails 40 are further disposed at the infeed end 26 of the frame assembly 22 and the pack table 30.

In the present embodiment, the case sealer 20 also includes one or more tape cartridges that are adapted to apply a length of tape to a case or box that is moved through the sealer. In FIG. 1, the case sealer 20 include a first tape cartridge 42A coupled to the top head assembly 34 to apply tape to a top face of a box and a second tape cartridge 42B coupled to the frame assembly 22 to apply tape to a bottom face of the box. However, in other embodiments, the case sealer 22 may include only one of the first and second tape cartridges 42A and 42B. In one example, the tape cartridges 42 can be CASELOCKER™ brand tape cartridges commercially available from Loveshaw, an ITW Company, of South Canaan, Pa.

Figure 2:
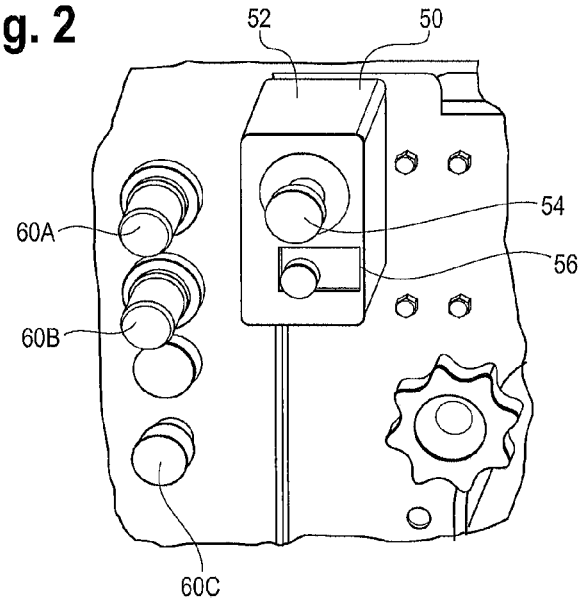
FIG. 2 is an enlarged isometric view of a control station and pneumatic regulators of the case sealer of FIG. 1.

The case sealer 20 includes control circuitry and systems for controlling the operation of electrical and mechanical components of the sealer, as will be described in more detail hereinafter and as would be apparent to one of ordinary skill. Referring to FIG. 2, for example, the case sealer 20 includes a movable control station 50 that can communicate with electrical and electro-mechanical components of the sealer in any known wired or wireless manner. In one example, the control station 50 includes magnets that allow the control station to be placed on any metal surface of the sealer 20. This versatility allows an operator to locate the machine controls to best fit their position at the sealer 20. The control station 50 of FIG. 2 includes a housing 52 that encloses electrical control circuitry, a push/pull mushroom head emergency stop switch 54, and a momentary start pushbutton 56. In other embodiments, the control station 50 may include additional components thereon or otherwise coupled thereto, such as a display screen, a keyboard, mouse, other input/output devices, etc.

Further, the case sealer 20 can be powered by any known means. In one example, the case sealer 20 is powered by electrical couplings and compressed air. Referring still to the example of FIG. 2, the case sealer 20 includes pneumatic regulators 60 for receiving compressed air that is used to drive various components of the sealer. More particularly, the case sealer 20 includes first, second, and third regulators 60A, 60B, and 60C, respectively. In the present example, the first and third regulators 60A, 60C control a lifting motion of the top head assembly 34 and the second regulator 60B controls actuation of the side rails 40.

More specifically, the first regulator 60A controls the lifting pressure of the head assembly 34 and is normally set to about 80 psi. Lowering the air pressure coupled to the first regulator 60A may result in the top head assembly 34 moving upward slowly, while increasing the air pressure will make the head assembly travel upward more quickly.

The third regulator 60C controls the downward force the top head assembly 34 will exert on the top face of a box to be sealed. By decreasing the air pressure coupled to the third regulator 60C, the head assembly 34 will exert more downward force on the box, which may be desirable for overfilled box conditions. Increasing the air pressure will lessen the downward force of the top head assembly 34, which may be desirable for voided or underfilled boxes. However, too much air pressure may inhibit the top head assembly 34 from lowering downward onto the box or may cause a box to stall within the sealer 20 due to belts of the top drive 36 not contacting the box with sufficient traction to move the box.

The second regulator 60B controls the pressure with which the side rails 40 center and hold the box. By increasing the air pressure coupled to the second regulator 60B, the side rails 40 can center heavier boxes on the pack table 30. However, by increasing the air pressure the side rails 40 have more clamping force which may make it more difficult to advance a box into the sealer 20. In some situations, such as with light boxes, lowering the air pressure coupled to the second regulator 60B may be desirable. However, the air pressure should be sufficient to allow the side rails 40 to fully traveling inward.

Figure 3:
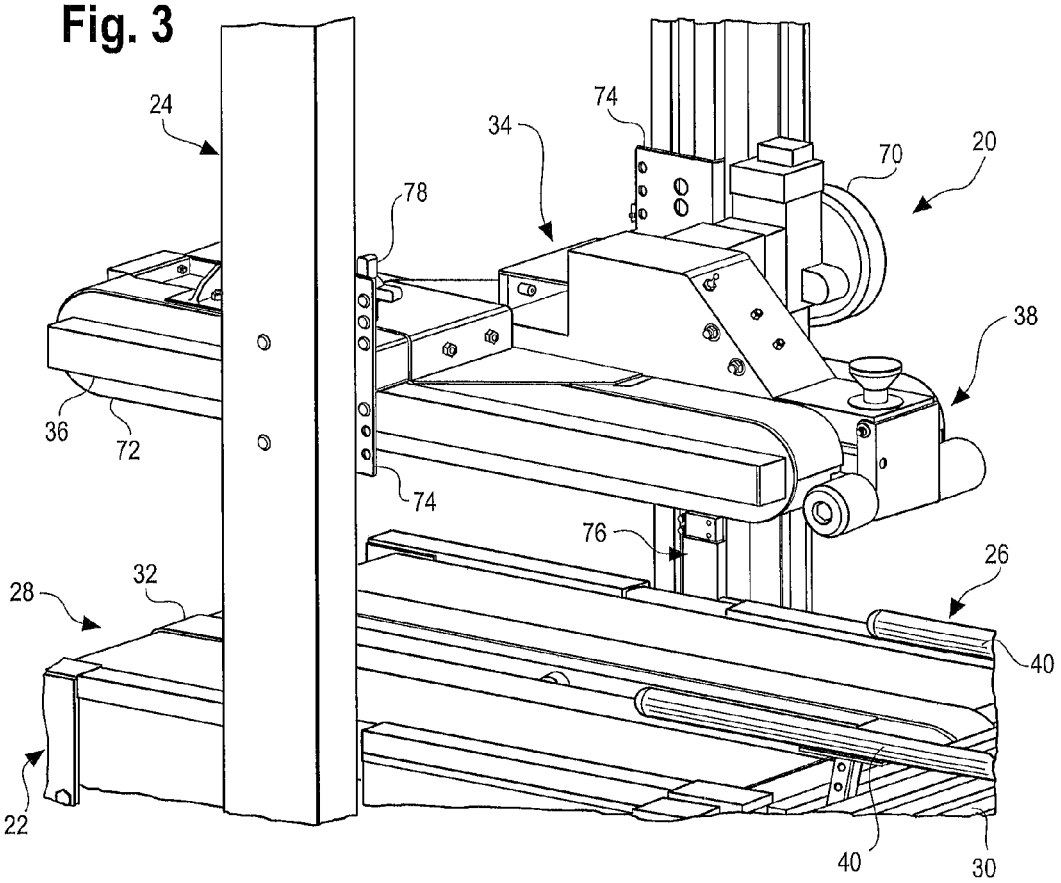
FIG. 3 is an enlarged isometric view of a top head assembly of the case sealer of FIG. 1 with portions of the case sealer removed for clarity of illustration.

Referring now to FIG. 3, the top head assembly 34 includes a motor 70 and a top belt 72, which can be an endless, guided, rough top belting. The top head assembly 34 may further include other components, such as sprockets, screws, tensioning elements, a chain, and the like for securing and driving the top belt 72 which components will be recognized by those skilled in the art. In addition, the top head assembly 34 according to the present embodiment includes brackets 74 that extend from sides thereof. The brackets 74 are provided to couple the top head assembly 34 to actuating components disposed in the mast assembly 24. In one example, the actuating components include one or more pneumatic head lifting cylinders or pistons 76 for raising and lowering the top head assembly 34.

The top head assembly 34 generally assists in conveying the box forward through the sealer 20. Further, the top head assembly 34 insures that tall unstable boxes will not topple over as they progress through the sealer 20. In one embodiment, the top belt 72 has an integral guide rib on a back portion thereof (not shown). This guide may be utilized to eliminate any other sophisticated apparatus to track the belt 72. Further, the use of an endless belt may have increased longevity over conventional laced belting.

The top head assembly 34 may also incorporate an adjustable top head assembly limiter 78. The head limiter 78 controls the minimum height of the top head assembly 34 at its starting point or home position. The head limiter 78 allows for more throughput speed by limiting how far the top head assembly 34 travels downwardly before it clears the height of the box to be processed. For example, if the minimum box height to be processed is 10 inches, the head limiter 78 can be set so the home position of the head assembly 34 is at 9.5 inches. By setting the limiter 78, the head 34 only travels downward to the 9.5 inch position after each box. Further, the top head assembly limiter 78 may also be used as a uniform lock feature so that the head assembly 34 can be locked at a specific position to process a batch of same size boxes.

Figure 4:
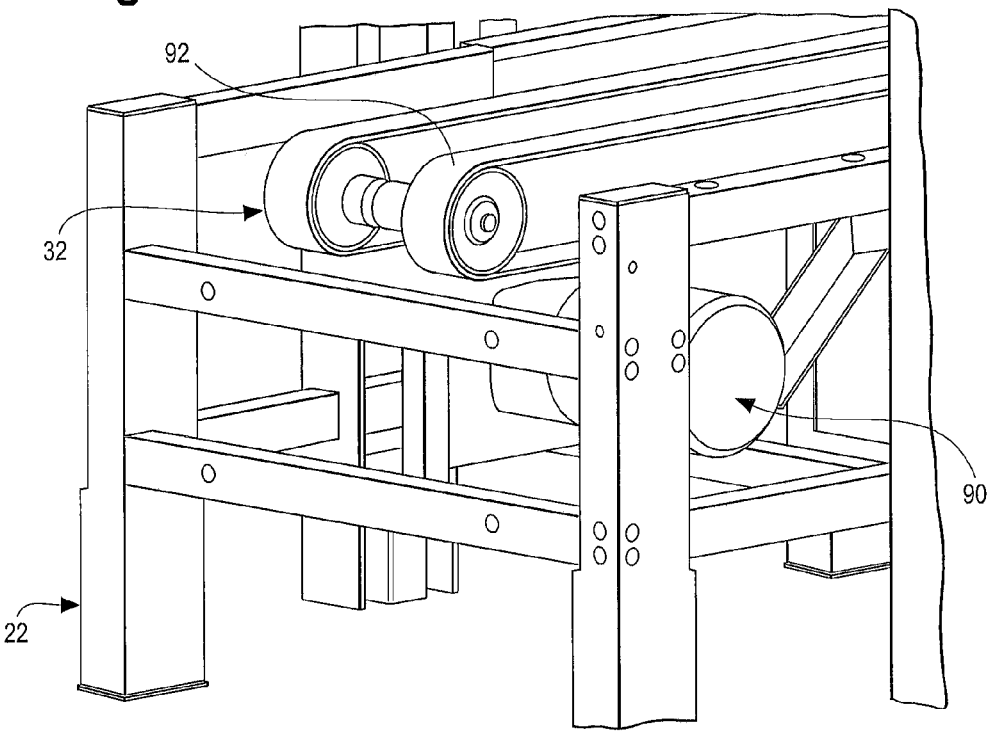
FIG. 4 is an enlarged isometric view of a bottom drive assembly of the case sealer of FIG. 1 with portions of the case sealer removed for clarity of illustration.

FIG. 4 illustrates further details of the bottom drive assembly 32, which includes a motor 90 and bottom drive belts 92, which can be an endless, guided, rough top belting. The bottom assembly 32 may further include other components, such as sprockets, screws, tensioning elements, a chain, and the like, which will be recognized by those skilled in the art, for securing and driving the bottom belt 92. In the present embodiment, the bottom drive assembly 32 is the main driver in conveying the box forward through the sealer 20 and ensures that boxes will travel through the sealer without stalling. Similarly to the top head assembly 34, the bottom drive assembly 32 may have an integral guide rib on a back portion thereof (not shown). This guide eliminates any other sophisticated apparatus to track the belt. Further, the use of an endless belt feature has increased longevity over conventional laced belting.

Figure 5:
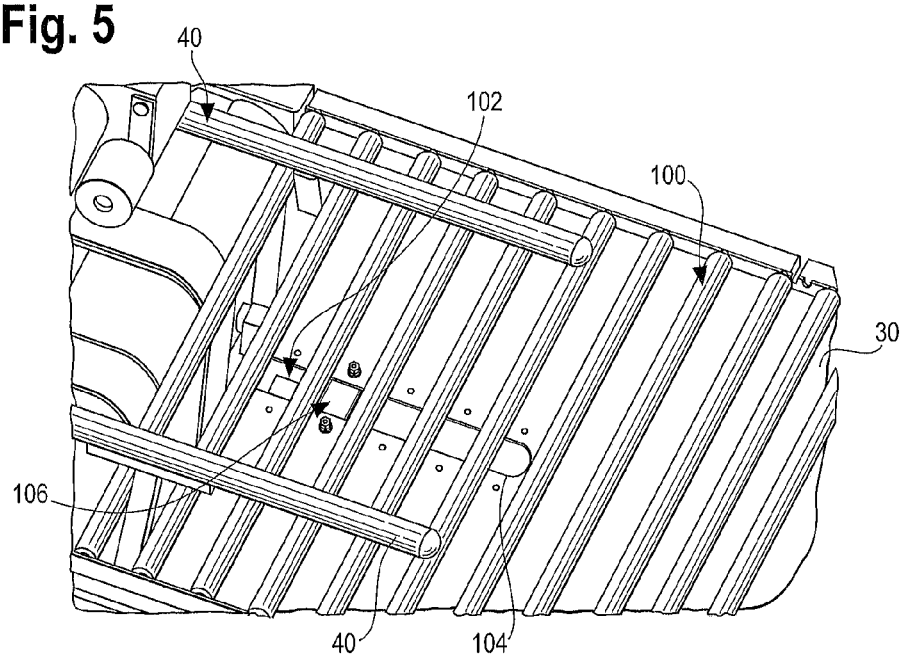
FIG. 5 is an enlarged isometric view of an infeed end of the case sealer of FIG. 1.

Referring now to FIGS. 1 and 5, the pack table 30 includes a plurality of conveyor rollers 100 that allow it to be used as a platform on which to fill a box and then convey the filled box to the infeed 26 of the sealer 20. The pack table 30 also includes a sensor 102 for detecting the presence of a box at the infeed 26. In one example, the sensor 102 can be a photoelectric sensor mounted under the pack table 30 in an opening 104 disposed therein. A sensing area of the sensor 102 is directed up through the rollers 100 of the table 30 to detect a box that is rolled over the top of the sensor. When the sensor 102 detects the box, the side rails 40 can be controlled to travel inward to center and hold the box in place. With the box held in position, an operator can fill it without the box moving around. When the box is filled, the top flaps can be folded down and the box pushed up against the sensing paddle 38 and subsequently sealed, as will be described in more detail hereinafter. As the box proceeds through the sealer 20, at some point the box will pass over the sensor 102 and the side rails 40 will be controlled to open.

In one embodiment, the sealer 20 incorporates an adjustable bracket 106 for mounting the sensor 102. The bracket 106 allows various positions to trigger the side rails 40 inward. By mounting the bracket 106 closer to the infeed 26 of the sealer 20, the side rails 40 will close on a greater length of the box side faces. This position is optimal to hold the box in place, such as if the operator is loading product into the box before sealing it. By mounting the sensor 102 closer to the beginning of the pack table 30, the side rails 40 will close in sooner as the box is moved toward the infeed 26 of the sealer 20. This position is optimal if the box is already filled and the flaps are folded. The operator can advance the box and the side rails 40 will center it, as the box is moving.

Further, like the top head assembly 34, the side rails 40 may also include a uniform lock mechanism 108 for locking the side rails at a specific position to process a batch of same size boxes (see, e.g., FIG. 1). The top head and side rail assemblies 34, 40 can be locked in either tandem or individually dependant on need. This increases the throughput of the sealer 20 since it does not have to readjust for each the box.

Figure 6:
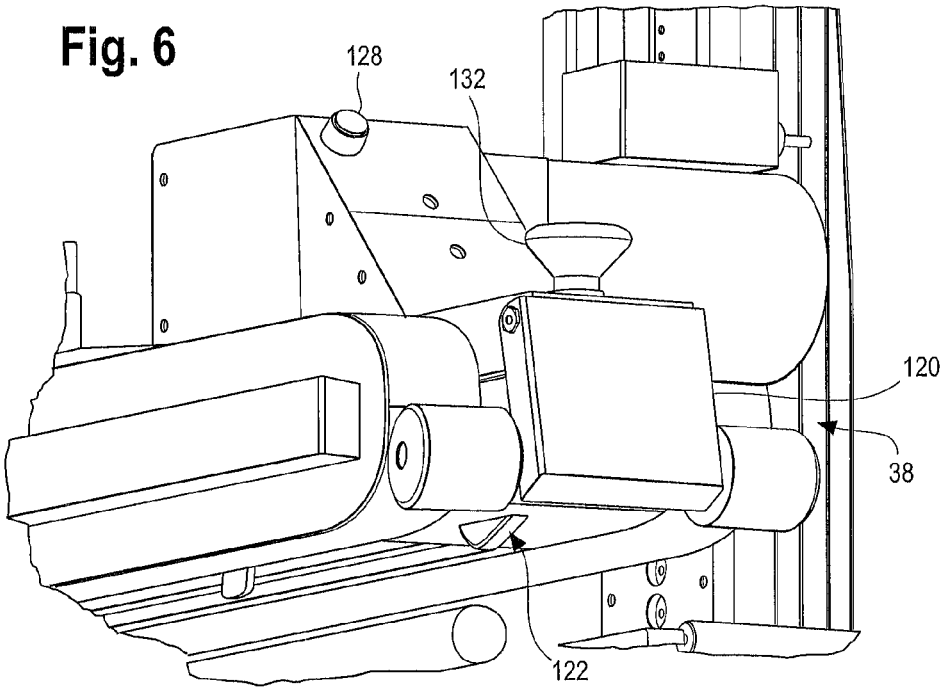
FIG. 6 is an enlarged isometric view of a sensing paddle assembly of the case sealer of FIG. 1.
Figure 7:
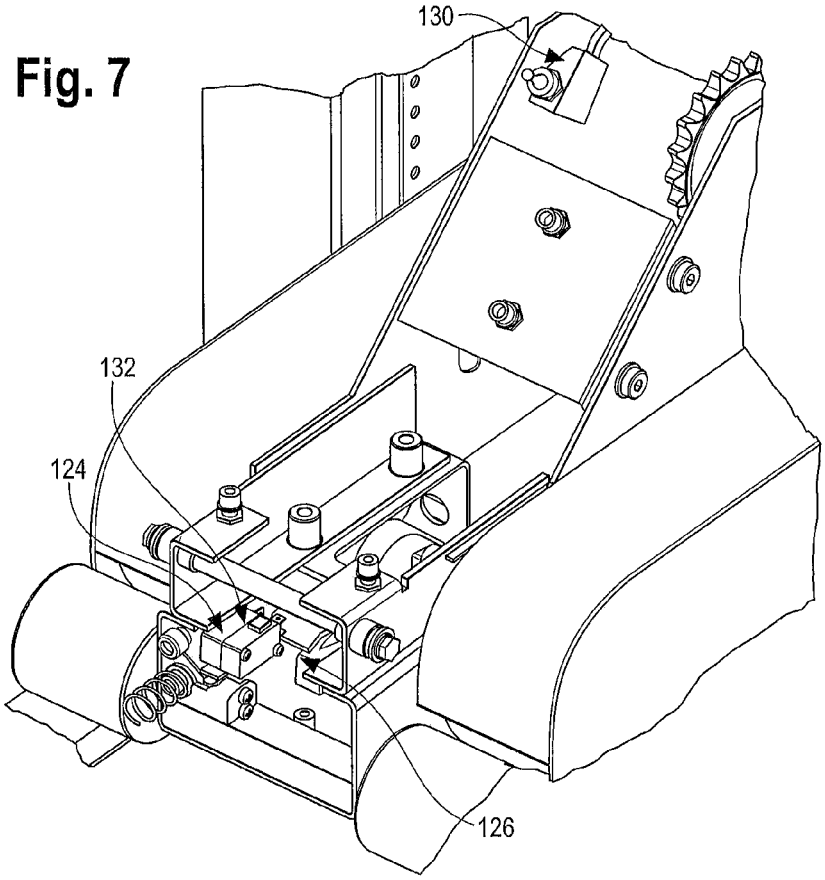
FIG. 7 is an enlarged isometric view of the sensing paddle assembly of FIG. 6 with portions removed for clarity of illustration.

The sensing paddle assembly 38, as seen more clearly in FIGS. 6 and 7, includes a front sensing paddle 120 and a top sensing paddle 122. According to one example, the front sensing paddle 120 is configured to be disposed in a front facing direction towards an infeed 26 of the case sealer 20 and the top sensing paddle 122 is configured to be disposed in a downward facing direction behind the front sensing paddle 120. In the illustrated embodiment, the front and top sensing paddles 120, 122 are coupled to first and second air switches, 124, 126 respectively. The front sensing paddle 120 functions generally to measure the height of a box at the infeed 26 of the sealer 20 and cause the top head assembly 34 to move upward to clear the top of the box. The top sensing paddle 122 functions to sense a top face of the box and to eliminate false head raise triggering, as will be described in more detail hereinafter.

The sensing paddle assembly 38 according to the present embodiment further includes a pushbutton 128 coupled to a third air switch 130 that functions as a manual head assembly 34 raise switch. Depression of the pushbutton 128 and opening of the third air switch 130 allows the head assembly 34 to be manually raised when the sealer 20 is not in operation. For example, with the sealer 20 stopped and an emergency stop switch 132 activated, the pushbutton 128 can be depressed and the head assembly 34 manually raised. The inclusion of the manual head assembly raise function may be convenient when re-filling the tape cartridges 42 or for clearing box jams.

The sensing paddle assembly 38 may also include components to enable a high-speed operating mode to increase throughput. In one example, the high-speed operating mode increases the speed of the belts 72, 92 from 115 ft/min to 155 ft/min and includes a head raise dampening circuit. The head raise dampening circuit limits the amount of over travel the top head assembly 34 will experience as it senses the height of the box. More particularly, the top head assembly 34 travels upward as the front sensing paddle 120 is depressed and gains speed as it raises up. When the front sensing paddle 120 is released, the head 34 continues to travel upward until its momentum dissipates. The dampening circuit is triggered when the front sensing paddle 120 is released and cylinder exhaust blocking valves of the head lifting cylinders 76 are closed for a short period to counteract the upward momentum of the top head assembly 34.

According to one embodiment, the high-speed operating mode is implemented by an electrical limit switch 132 that provides an electrical signal when the front panel of the box releases the front sensing paddle 120. The electrical signal is fed to a one shot logic module with time delay, which can be incorporated into the limit switch 132 or can be a component included in the control station 50, for example. The logic module turns off the cylinder exhaust blocking valves of the head lifting cylinders 76 in response to the electrical signal to reduce the amount of over shoot that the top head assembly 34 would normally travel. By stopping the top head assembly's upward momentum abruptly once it passes the top of the box, the sealer's box cycle time is reduced.

Figure 8:
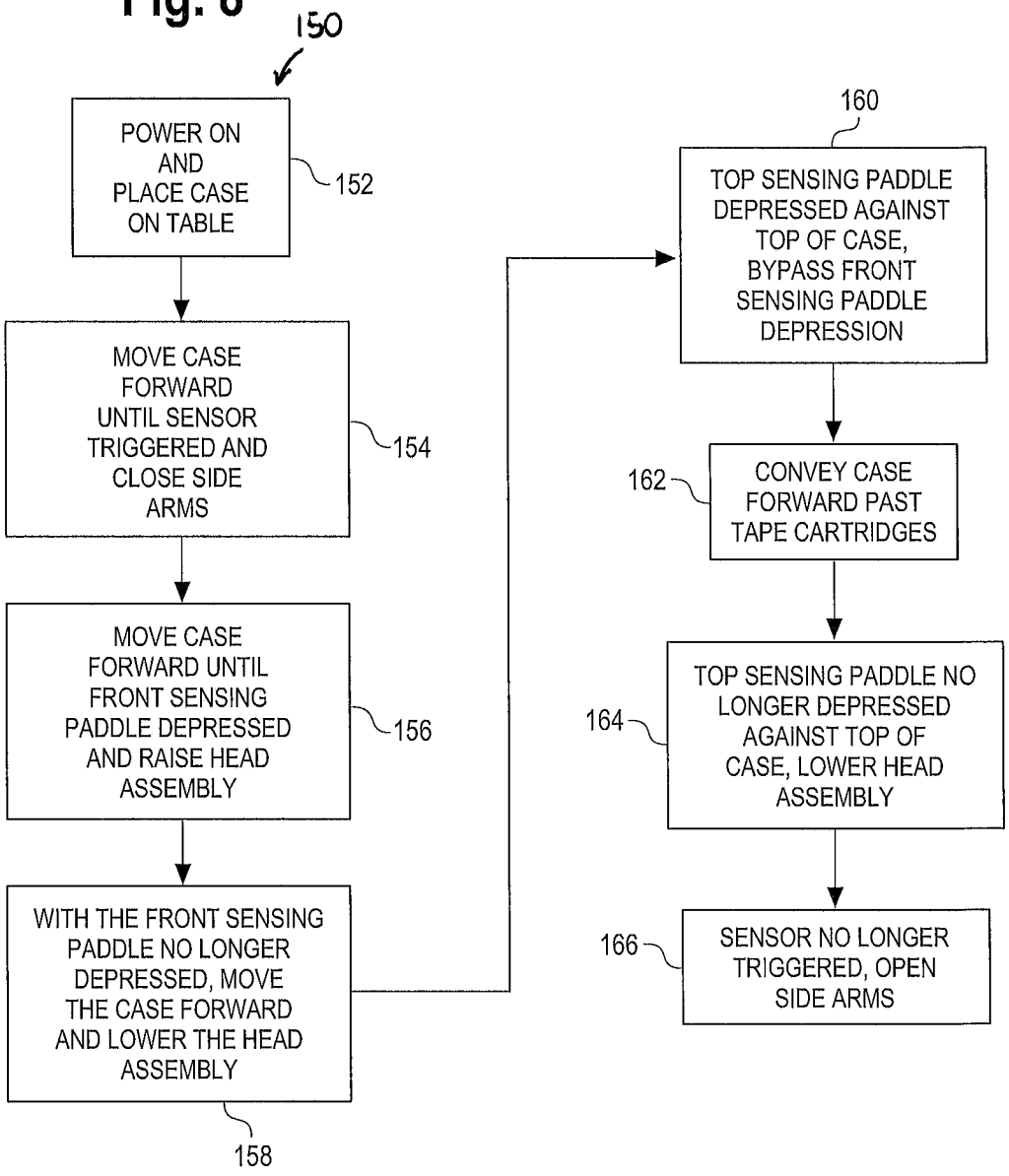
FIG. 8 is an operational block diagram of an operating scheme for the case sealer sensor assembly.

In general, the case sealer 20 is configured to adjust itself automatically for the width and height of a case or box to be sealed and to seal said box in an automated or semi-automated manner. Referring to FIG. 8, a procedure 150 for sealing a box begins at a block 152 during which the sealer 20 is powered on and a box is placed on the infeed pack table 30. After the block 152, the procedure 150 continues at a block 154 and the box is moved forward, such as manually by a user, until the sensor 102 is triggered. When the sensor 102 is triggered at the block 154, the side rails 40 are controlled to travel inward to center the box on the pack table 30 and hold it in place. In one example, the side rails 40 are coupled to a solenoid valve (not shown) that is energized to cause the rails to travel inward. At this point, an operator is able to fill the box with product and fold the top flaps of the box down.

At a block 156, the operator pushes the box forward until a front panel of the box contacts the front sensing paddle 120. During the block 156, the front sensing paddle 120 is depressed and contacts the first air limit switch 124 which in turn fills the head lifting cylinders 76 and causes the top head assembly 34 to travel upward. When the top head assembly 34 raises higher than the box to be sealed, the front sensing paddle 120 is no longer depressed, the first air switch 124 is released, and the head assembly 34 stops traveling upward. The procedure 150 then continues at a block 158 and the top head assembly 34 begins to travel downward on top of the box as the box is moved forward manually and/or by the top and bottom drive belts 72, 92 moving the box forward through the sealer 20. Optionally, the blocks 156 and 158 may include steps performed in a high-speed operating mode, wherein the limit switch 132 generates an electrical signal when the front sensing paddle 120 is no longer depressed and the electrical signal is used to control a head raise dampening circuit that limits the over travel of the top head assembly 34 beyond the top of the case.

As the top head assembly 34 travels downward and the box forward, control passes to a block 160 where the top sensing paddle 122 is depressed against a top face of the box which in turn opens the second air switch 126. The triggering of the second air switch 126 nulls out or bypasses the first air switch 124 to eliminate false head raise triggering, such as may happen with a box having an uneven top. For example, without the top sensing paddle 122, an overstuffed box with an uneven top can retrigger the front sensing paddle 120, causing the head to raise up again and result in taping or jamming issues in the sealer. In the present embodiment, the depression of the top sensing paddle 122 prevents the head assembly 34 from moving upward even if the front sensing paddle 120 is depressed.

With the top sensing paddle 122 depressed, control passes to a block 162 and the box is conveyed forward through the tape cartridges 42 and tape is applied to seal the box. At a block 164, the box exits the outfeed 28 of the sealer 20 and the top head assembly 34 lowers down to the home position. At a block 166, the sensor 102 no longer detects the box, de-energizing the side rails 40 and causing them to open to home positions. The block 166 is illustrated following the block 164 but can be performed at any point during the procedure 150 as soon as the sensor 102 no longer detects the box, such as after the block 156.

Figure 9:
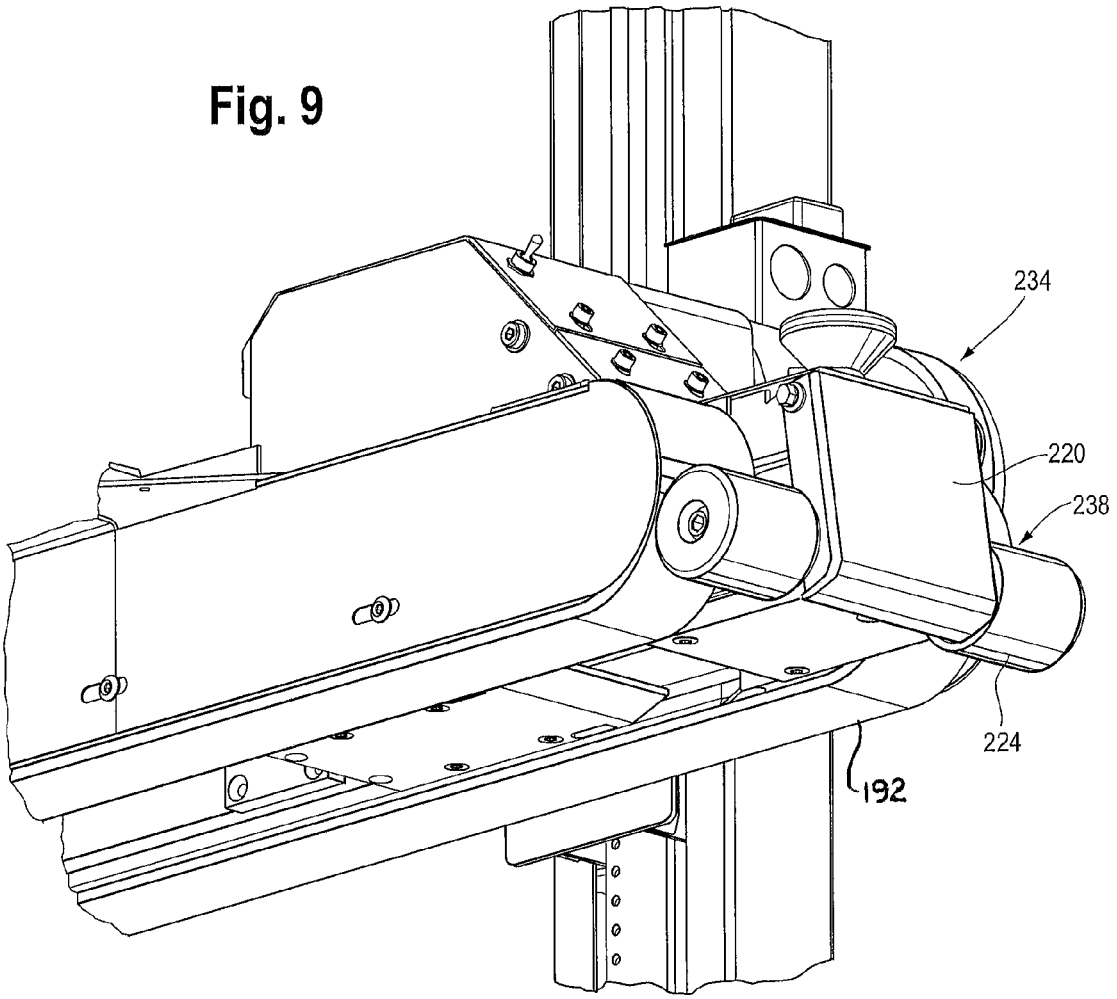
FIG. 9 is an enlarged isometric view of an alternate sensing paddle assembly.
Figure 10:
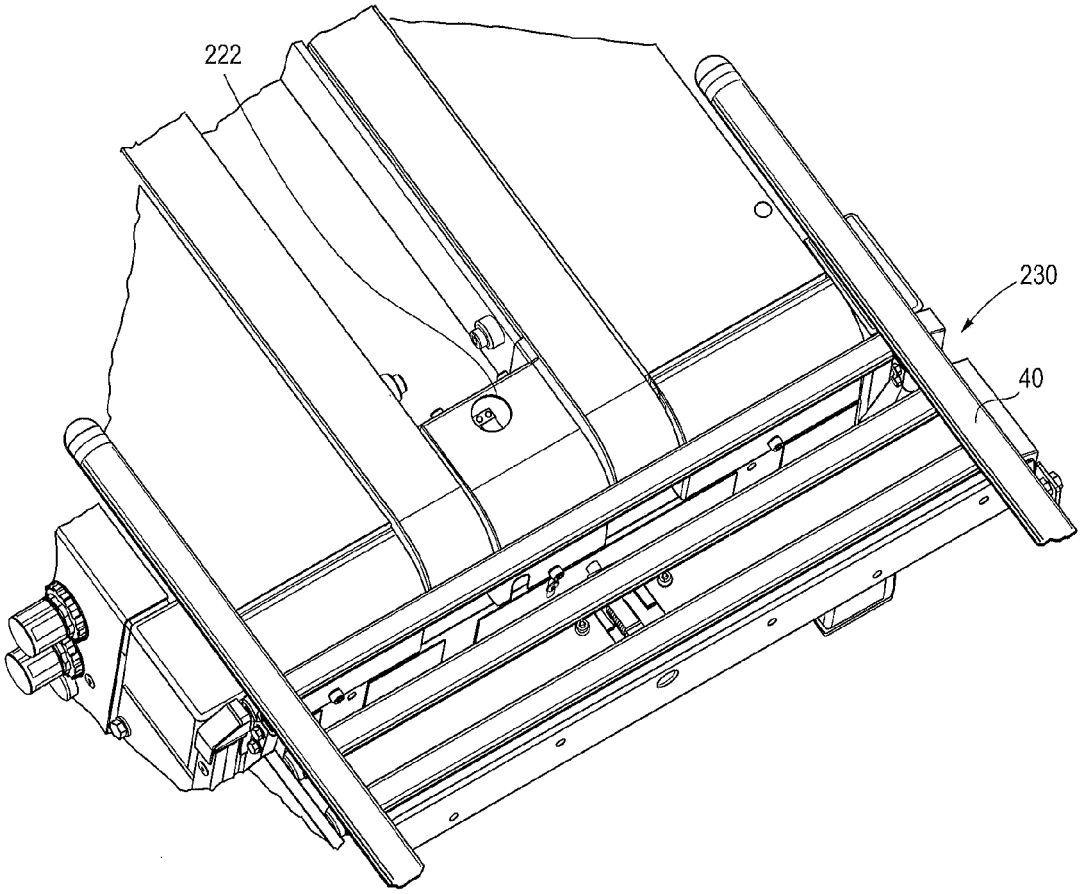
FIG. 10 is an isometric view of the work surface (frame) of the case sealer showing the load front sensor located between the box conveyor belts.
Figure 11:
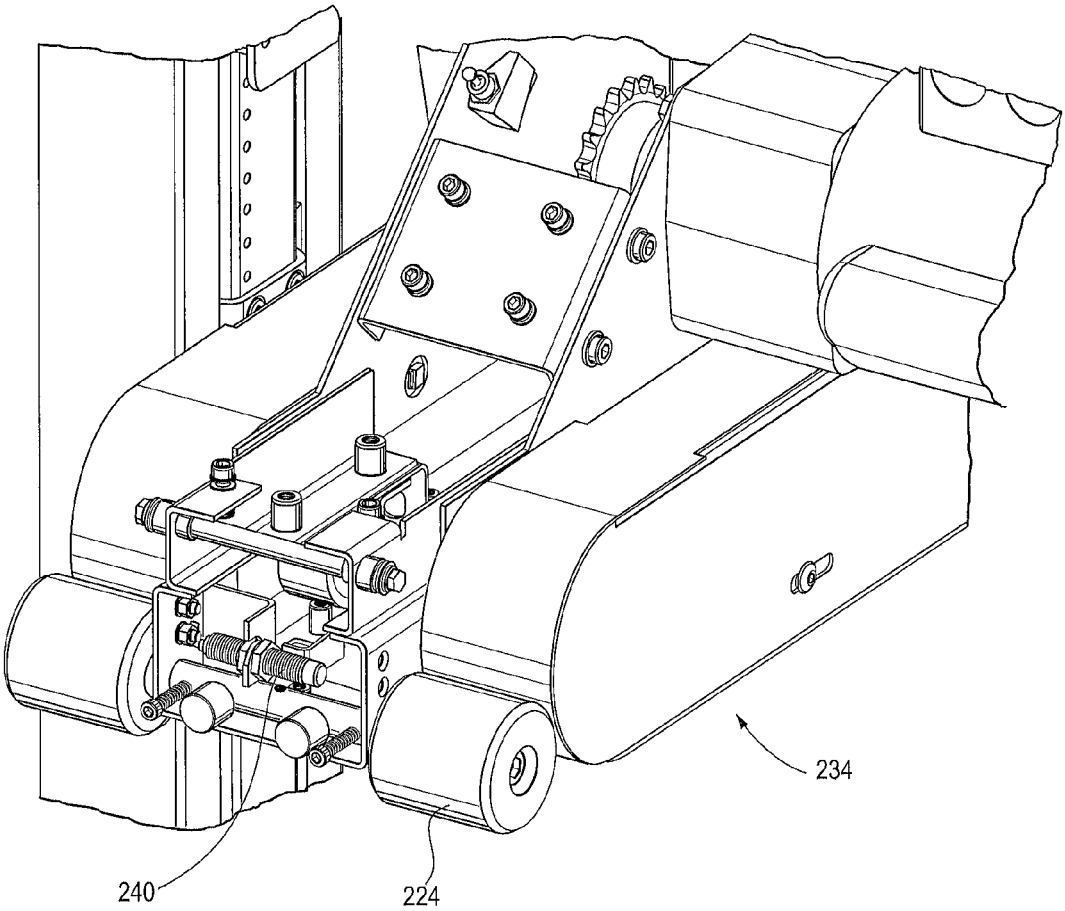
FIG. 11 is an enlarged isometric view of the sensing paddle assembly of FIG. 9 with portions removed for clarity of illustration.

An alternate embodiment of the sensing paddle assembly 238 is illustrated in FIGS. 9-11, in which the top sensing paddle 122 is replaced with a load front sensor 222. In the illustrated alternate embodiment, the load front sensor 122 is located on the frame assembly or pack table 230, below the top head assembly 234. As seen in FIG. 10, the load front sensor 222 can be located between the drive belts 192 on the table 230, below the top head assembly 234. The load front sensor 222 functions in a similar manner to the top sensing paddle 122—that is, when the load front sensor 222 senses the presence of a box, it nulls out the head lifting function of the front sensing paddle 220 (to prevent false head raise triggering) once it senses that a box is in the sealer and is progressing toward the tape head. The load front sensor 222 can be a proximity-type sensor. The use of a sensor precludes the need for a mechanical or electro-mechanical switch, which could otherwise be subjected to wear.

The load front sensor 222 can also be used in conjunction with sensor 102 to control movement of the side rails 40. In one contemplated configuration, the load front sensor 222 is used to sense the presence of absence of a box over the sensor 222 and to signal to the controller to maintain the side rails in the inward state to maintain the box centered in the sealer. In this configuration, the side rails will be directed outward only after the box has moved past the load front sensor 222. Essentially, sensor 102 controls inward movement of the side rails, and the load front sensor 222 controls outward movement of the side rails, as well as nulling out the head lifting function. This maintains the side rails on the box for a longer portion of the conveying and sealing operation.

Also as seen in FIG. 11, one or both of the first and second air switches (124, 126 in FIG. 7), which are electro-mechanical devices located in the sensing paddle assembly, can be replaced by one or more proximity sensors 240. The proximity sensors 240 detect the presence of the front sensing paddle 220 as it is moved rearward by contact of a box with the paddle 220 (or paddle rollers 224). Again, this eliminates the need for an electro-mechanical switch, which could otherwise be subjected to wear, replacing it with an electrical sensor. The proximity sensor or sensors 240 function in the same manner to actuate the air cylinders 76 for moving the top head assembly 234.

Other components of the case sealer 20 are hidden from view or not described in detail herein, it being understood that such components would be apparent to and understood by one of ordinary skill in the art. For example, such components may include fuses, contactors, overload relays, and terminal blocks that are selected to protect the sealer from short circuit and overload conditions.

In the present disclosure, the words "a" or "an" are to be taken to include both the singular and the plural. Conversely, any reference to plural items shall, where appropriate, include the singular.

Numerous modifications to the present disclosure will be apparent to those skilled in the art in view of the foregoing description. Accordingly, this description is to be construed as illustrative only and is presented for the purpose of enabling those skilled in the art to make and use the disclosure and to teach the best mode of carrying out same. The exclusive rights to all modifications which come within the scope of the present disclosure are reserved.

What is claimed is:

1. A case sealer, comprising:

a frame assembly having an infeed end and an outfeed end;

a top head assembly coupled to move substantially vertically with respect to the frame assembly, the top head assembly having a first end corresponding to the infeed end and a second end corresponding to the outfeed end;

a sensor positioned at the first end of the top head assembly for sensing a front face and a top face of a case to be sealed;

a bottom drive coupled to the frame assembly and a top drive coupled to the top head assembly, the bottom drive configured to engage a bottom surface of a case and the top drive configured to engage a top surface of a case, wherein the bottom and top drives convey a case to be sealed past one or more tape cartridges associated with the frame assembly; and a controller for moving the top head assembly substantially vertically when the sensor senses the front face of the case and for preventing the substantially vertical movement of the top head assembly when the sensor senses the top face of the case, wherein the sensor includes a front sensing paddle for sensing the front face of the case and a top sensing paddle for sensing a top face of the case and the controller is configured to move the top head assembly substantially vertically in response to the front sensing paddle sensing the front face of the case, wherein the front sensing paddle is configured to be disposed in a front facing direction towards an infeed of the case sealer, and wherein the controller is configured to prevent substantially upward vertical movement of the top head assembly in response to the top sensing paddle sensing the top face of the case, wherein the top sensing paddle is configured to be disposed in a bottom facing direction behind the front sensing paddle.

2. The case sealer of claim 1, further comprising a mast assembly disposed around the frame assembly and an actuating component coupled to the mast assembly, wherein the top head assembly is coupled to the actuating component, which moves the top head assembly substantially vertically with respect to the frame assembly.

3. The case sealer of claim 1, further comprising a pack table abutting the infeed end of the frame assembly, moveable side rails at the infeed end of the frame assembly and the pack table that can be actuated inwardly to center the case, the pack table including a sensor disposed in front of the infeed end for detecting the case and actuating the side rails inwardly, and a mechanism for adjusting the position of the sensor with respect to the infeed end.

4. The case sealer of claim 3, further comprising at least one mechanism for locking the top head assembly and/or the side rails at one or more specific positions for processing a batch of same size cases.

5. The case sealer of claim 1, further comprising a limiter for controlling a minimum height of the top head assembly at a starting point.

6. The case sealer of claim 1, further comprising a pack table abutting the infeed end of the frame assembly, moveable side rails at the infeed end of the frame assembly and the pack table that can be actuated inwardly to center the case, and a second sensor disposed at the pack table for detecting the case and actuating the side rails inwardly.

7. The case sealer of claim 1, wherein a top head assembly actuating component is filled with air to lift the top head assembly vertically upward in response to the front sensing paddle being depressed by the front face of the case and contacting a first air limit switch, the top head assembly travels vertically downward in response to release of the front sensing paddle, and the top sensing paddle is depressed and contacts a second air limit switch in response to contacting the top face of the case, wherein the second air limit switch nulls out or bypasses the first air limit switch to prevent vertical upward movement of the top head assembly.

8. The case sealer of claim 1, wherein a first regulator controls lifting pressure of the top head assembly by controlling air pressure within a top head assembly actuating component in response to the front sensing paddle sensing the front face of the case and a second regulator controls downward force of the top head assembly on the top face of the case by controlling air pressure within the top head assembly actuating component in response to the top sensing paddle sensing a top face of the case to prevent vertical upward movement of the top head assembly.

* * * * *